US005486011A

United States Patent [19]

Nelson

[11] Patent Number: 5,486,011

[45] Date of Patent: Jan. 23, 1996

[54] SPRING BIASED BRAKING DEVICE FOR IN-LINE ROLLER SKATES

[76] Inventor: Randy Nelson, 1075 Rollins Rd., #208, Burlingame, Calif. 94010

[21] Appl. No.: 252,915

[22] Filed: Jun. 2, 1994

[51] Int. Cl.[6] ..... A63C 17/06; A63C 17/14

[52] U.S. Cl. ..... 280/11.2; 280/11.22; 280/11.28

[58] Field of Search ..... 280/11.2, 11.22, 280/11.23, 11.28

[56] References Cited

U.S. PATENT DOCUMENTS

| | | | |
|---|---|---|---|
| 332,278 | 12/1885 | Nelson et al. | 280/11.2 X |
| 3,339,936 | 9/1967 | Hamlin | 280/11.2 |
| 4,061,348 | 12/1977 | Carter | 280/11.21 |
| 4,234,204 | 11/1980 | Tibbals | 280/87.04 |
| 4,272,091 | 6/1981 | Reid, Jr. | 280/11.28 |
| 4,351,538 | 9/1982 | Berta | 280/11.26 |
| 4,909,523 | 3/1990 | Olson | 280/11.2 |
| 4,911,456 | 3/1990 | Sarazen | 280/11.2 |
| 5,088,748 | 2/1992 | Koselka et al. | 280/11.2 |
| 5,118,122 | 6/1992 | Ricart | 280/11.2 |
| 5,135,244 | 8/1992 | Allison | 280/11.28 |
| 5,183,276 | 2/1993 | Pratt | 280/11.22 |
| 5,192,099 | 3/1993 | Riutta | 280/11.2 |
| 5,232,231 | 8/1993 | Carlsmith | 280/11.2 |
| 5,251,920 | 10/1993 | McHale | 280/11.19 |
| 5,320,367 | 6/1994 | Landis | 280/11.2 |
| 5,342,071 | 8/1994 | Soo | 280/11.2 X |

FOREIGN PATENT DOCUMENTS

| | | | |
|---|---|---|---|
| 143245 | 8/1903 | Germany | 280/11.2 |
| 2942969 | 5/1981 | Germany | 280/11.22 |
| 62701 | 2/1949 | Netherlands | 280/11.2 |
| 2160780 | 1/1986 | United Kingdom | 280/11.2 |

OTHER PUBLICATIONS

N. Feineman, *Wheel Excitement*, William Morrow and Co. (1991).

*Primary Examiner*—Brian L. Johnson
*Attorney, Agent, or Firm*—Medlen & Carroll

[57] ABSTRACT

A braking device for in-line skates including a resiliently biased, pivotally mounted load bearing wheel. The resilient element prevents contact between the wheel and a skate mounted braking surface during normal skating movements. The braking device is activated by exerting sufficient downward force on the load bearing wheel to overcome the resilient bias and thereby making frictional contact between the load bearing wheel and the braking surface.

20 Claims, 3 Drawing Sheets

SPRING BIASED BRAKING DEVICE FOR IN-LINE ROLLER SKATES

TECHNICAL FIELD OF THE INVENTION

The present invention relates to in-line roller skates. More particular, the present invention relates to braking devices for in-line skates.

Background of the Invention

In-line skates provide recreational enjoyment and highly beneficial exercise to many people of nearly all ages. Recent advances in skate design and a better understanding of the dynamics of skating have resulted in a desire to adapt ice figure skating techniques to in-line skating. Originally, the wheels of in-line skates were mounted in a flat row, i.e., all wheels are in contact with the ground when a skater is in a normal skating position. Wheels positioned in a flat row result in a skate with good stability enabling experienced skaters to reach sustained speeds of 30 mph. This wheel placement is similar to ice skates having a blade with a straight skating surface for speed or long distance skating.

Blades of ice figure skates have a curved skating surface, typically ending in one or more teeth at the toe section of the blade and usually having a sharp point at the heel section of the blade. The curvature of the blade is generally referred to as the skate's "rocker." It is the rocker which gives an ice figure skate its high maneuverability while the teeth or points are important for jumping, special movements and braking. Currently, many in-line skates are adapted to provide a rocker profile. This is achieved through a wheel mounting system in which the end wheels are positioned closer to the sole of the skate boot than the center wheels. A skater is thus skating mainly on the center wheels, resulting in enhanced maneuverability when compared to an in-line skate with wheels which are mounted in a flat row.

The rocker profile is particularly important in jumping since it is the rocker profile which enables the skater to initiate the momentum for tilting the skate to the skate's toe or heel section in preparation for the jumping movement. The tooth or point of an ice figure skate holds the blade firmly in place on the ice when the skate is tilted for jumping. In-line skates require a very effective brake on the front or rear wheel in order to keep the skate in place on the ground when tilted for braking or jumping, and particularly for landing following a jump.

A variety of braking methods have been developed for in-line skates. Generally, a skater can stop by executing a tight radius turn, or by placing one foot perpendicularly behind the leading foot and dragging the wheels of the perpendicularly placed skate on the ground, or by using a braking device.

Typically, braking devices for in-line skates include hand-operated brakes and foot-operated brakes. Hand-operated brakes depend on a cable or hydraulic linkage between a hand-actuated device and a skate mounted brake. These brakes are of little utility since it places a severe restriction on the arm and hand movements which are essential for good balance and graceful movements during skating. Commonly, foot-operated braking devices are the method of choice. They rely on one or more of the following techniques: (1) dragging a braking pad on the skating surface; (2) engaging an auxiliary wheel or roller which makes contact with a brake pad or braking surface; or (3) forcing one or more of the load bearing wheels against a braking surface.

Braking systems which rely on dragging a braking pad on the skating surface usually have a friction surface attached to the forward section of the skate or the skate boot (a toe stop) or a similar arrangement attached to the rear of the skate (a heel pad). The skater engages the toe stop by tilting the foot forward and applying force to the toe section of the boot. The heel pad is used for braking by advancing the foot forward and forcing the heel pad against the skating surface. While these surface brakes may enable the skater to slow down or stop, these systems do not provide braking force in a controlled manner since the braking action depends on the type of skating surface, surface roughness or unevenness, and the presence of loose materials on the surface.

The use of an auxiliary wheel for braking is exemplified in U.S. Pat. Nos. 5,118,122 (Ricart, 1992) and 5,088,748 (Koselka et al., 1992), disclosing an auxiliary non-load bearing wheel fitted to the front or the rear of a skate. These braking systems are activated by forcing an auxiliary wheel into contact with the ground and contacting the auxiliary wheel (or its linkage) with a friction surface. Auxiliary wheels are generally undesirable because they limit a skater's ability to make so called crossover turns which require the skater to step one foot in front of (or over) the other foot. An additional disadvantage of auxiliary wheel brakes is the need to apply braking forces to a point not directly underneath the skate boot; this is particularly difficult for young children.

Typically, the most effective in-line skate brakes use techniques wherein one or more load bearing wheels is subjected to a braking action. These methods generally consist of a three component braking device: (1) a skate or boot mounted friction surface, (2) a load bearing wheel capable of contacting the friction surface, and (3) a spring mechanism which keeps the load bearing wheel disengaged from the friction surface until the skater overcomes the spring bias by exerting additional force.

Several methods for subjecting load bearing wheels to braking action are known in the art. See, e.g., U.S. Pat. No. 5,232,231 (Carlsmith, 1993) which discloses a spring for keeping the boot heel biased away from the wheels. Forcing the heel down causes brake pads to contact brake drums on load bearing wheels. U.S. Pat. No. 5,192,099 (Riutta, 1993) teaches a rear load bearing wheel mounted in a flexible bracket, whereby when the skater exerts a downward force on the heel of the boot, the bracket flexes bringing a brake surface into contact with the rear wheel. U.S. Pat. No. 5,135,244 (Allison, 1992) in which is disclosed a tandem skate with wheel pairs which are pivotally connected to the skate base. Allison's braking action is caused by tilting the boot down at the toe or the heel, forcing a brake surface against the load bearing front or rear wheel. U.S. Pat. No. 4,061,348 (Carter, 1977) teaches a roller skate with a pivotally attached heel section spring biased away from the rear wheels, wherein a lateral linkage causes a braking force on the rear wheels when the heel is forced down. U.S. Pat. No. 3,339,936 (Hamlin, 1967) discloses a braking system for a two-wheel skate wherein the rear wheel is mounted on a bracket attached to the front of the skate boot. Downward pressure exerted by the heel forces a boot mounted brake pad against the rear wheel.

While the above patents disclose braking systems which generally allow the skater to reduce speed and stop, they do not appear to provide the skater with the ability to execute figure skating movements such as stopping and turning or jumping from a position wherein the in-line skate is tilted up at the toe or the heel.

Accordingly, the need exists for an in-line skate braking device resulting in an effective momentary braking action which will enable a skater to execute figure skating movements and maneuvers, particularly take-offs and landings on one of the end wheels.

Summary of the Invention

The present invention provides a device for braking in-line roller skates.

In one embodiment, the present invention provides an adjustable spring biased braking device for in-line skates wherein a load bearing wheel frictionally engages a braking surface when the preselected spring bias is overcome by exerting sufficient downward force on the wheel.

In an additional embodiment, the present invention provides an in-line skate having a spring biased braking device wherein a load bearing wheel frictionally engages a braking surface when the spring bias is overcome by exerting sufficient downward force on the wheel.

DETAILED DESCRIPTION OF THE INVENTION

While describing the invention and its embodiments, certain terminology will be utilized for the sake of clarity. It is intended that such terminology include not only the recited embodiments, but all technical equivalents which perform substantially the same function, in substantially the same manner to achieve substantially the same result.

Figure 1:
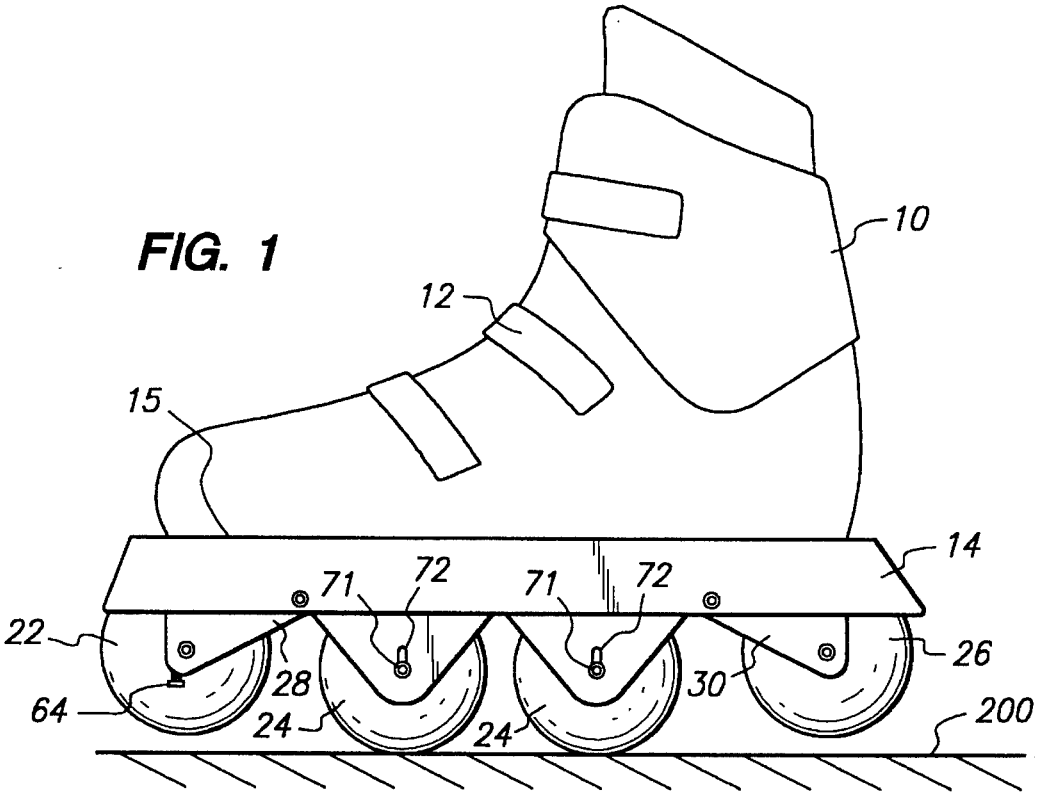
FIG. 1 is a side view of an in-line skate of the present invention.
Figure 2:
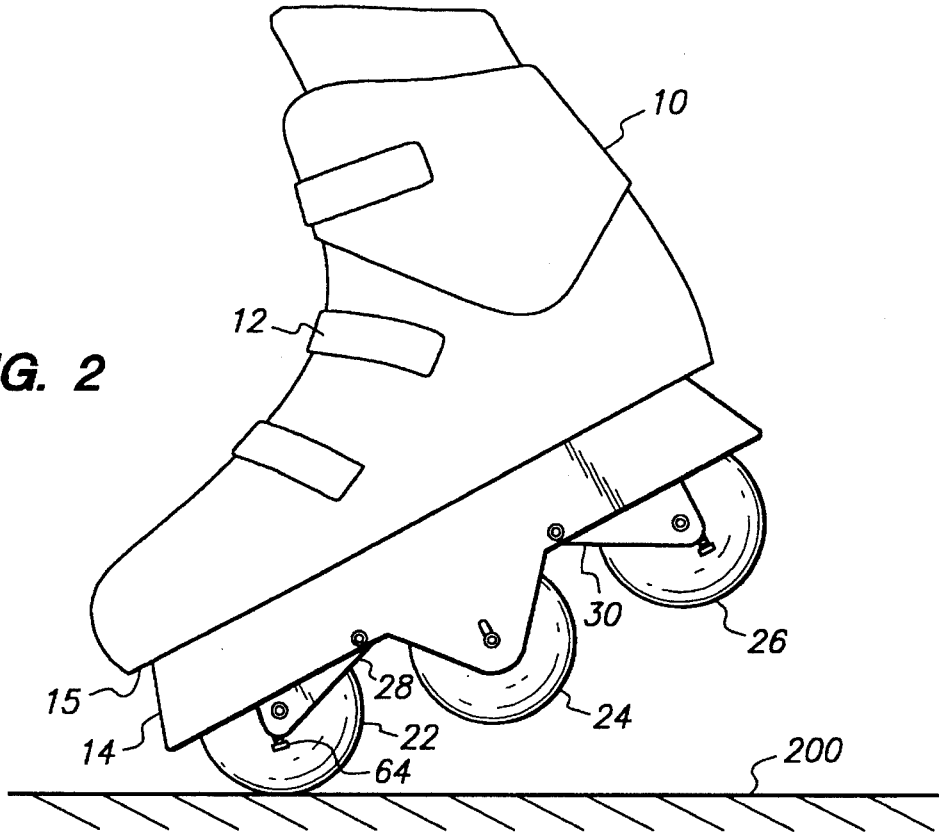
FIG. 2 is a side view of the in-line skate of FIG. 1 showing the skate in a braking position.

Referring to FIG. 1, an in-line skate of the present invention preferably includes a boot 10, with a fastening means, such as, for example, laces or buckles 12 for securing boot 10 to the skater's foot. A track assembly 14 can be mounted to the base 15 of the boot. Mounted along track assembly 14 are wheels 22, 24 and 26 which are all preferably aligned in the same vertical plane oriented longitudinally with the length axis of boot 10. The base 15 can consist of the sole of boot 10 or a rigid metal or plastic plate which can be secured to the sole of boot 10.

The embodiment illustrated in FIG. 1 shows front wheel 22 and rear wheel 26 each rotatably mounted in substantially identical pivoting brackets 28 and 30 respectively. The pivoting action of brackets 28 and 30 enables the skater to selectively use load bearing wheels 22 and 26 for either skating or for slowing down and stopping. The present embodiment is described using front wheel 22 and its associated braking device since this is identical with the braking device of rear wheel 26.

Figure 3:
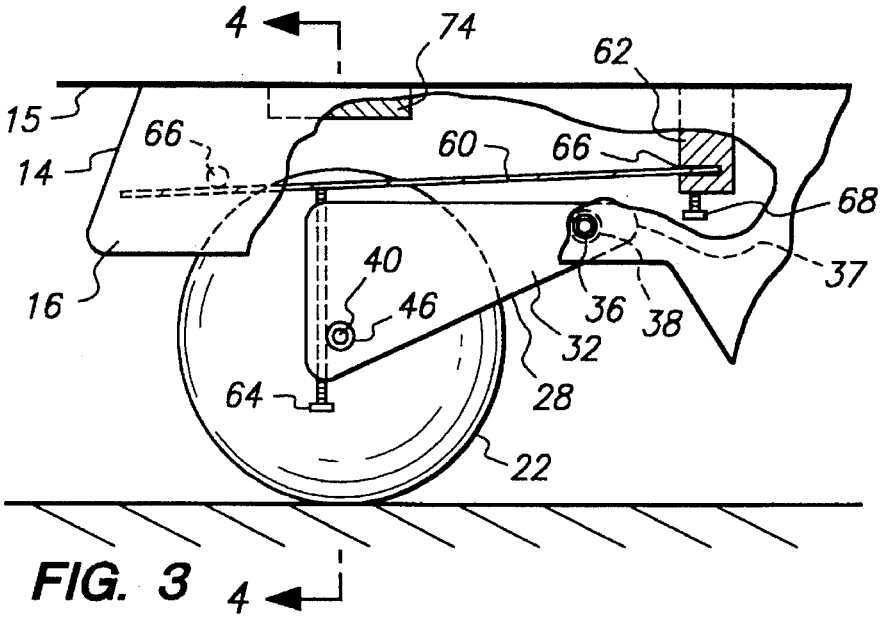
FIG. 3 is a side view, with parts broken away, of a braking device of the present invention.
Figure 4:
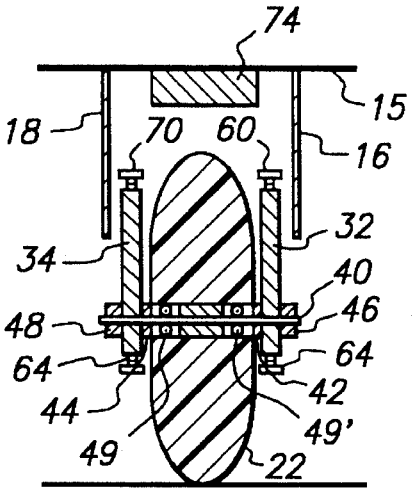
FIG. 4 is a sectional view of FIG. 3 along the lines 4—4 of FIG. 3.

Referring to FIGS. 3 and 4, bracket 28 includes bracket arms 32 and 34, and a means for pivotally mounting one end of the bracket arms 32, 34 to the track assembly 14 such as, for example, using axle 36 to rotatably mount bracket arms 32 and 34 to track assembly 14 through matching holes in the side walls 16 and 18 of the track assembly and the first end of these bracket arms. A bushing 38 is preferably mounted on axle 36 between bracket arms 32 and 34 to maintain proper spacing and alignment of these bracket arms. Preferably, one or more washers (not shown) are mounted on axle 36 between each bracket arm and the adjacent side wall. Axle 36 can be restrained to side walls 16 and 18 by conventional means such as nuts (not shown) fitted to threaded ends of axle 36.

Wheel 22 is mounted to the second end of bracket arms 32 and 34 using axle 40 which is mounted in matching holes in said second end, as depicted in FIGS. 3 and 4. Preferably, washers 42 and 44 are mounted on axle 40 between wheel 22 and the bracket arms. Axle 40 may be fixed to bracket arms 32 and 34 by conventional means such as nuts 46 and 48 fitted to threaded ends of axle 40. Typically, in-line skate wheel 22 is equipped with bearing assemblies 49, 49'.

As seen in FIGS. 3 and 4, a first end of a leaf spring 60 can be secured to a post 62 which can be attached to base 15 or to the track assembly 14. Leaf spring 60 is positioned along the side and spaced away from wheel 22. A finger projecting from the second end of bracket 32 abuts the bottom surface of leaf spring 60, and a finger projecting from the second end of bracket 34 abuts the bottom surface of leaf spring 60. The fingers can be provided, for example, by a threaded thumb screw 64 through the second end of bracket arm 32. The top surface of leaf spring 60 is restrained near its second end by a projection 66 which is secured to the inside of side wall 16. A second leaf spring 70 is similarly positioned along the other side of wheel 22. The resiliency of leaf springs 60 and 70 prevent wheel 22 from contacting brake pad 74 during normal skating maneuvers, i.e. when the skater does not exert additional force on wheel 22. The rear portion of the leaf springs 60, 70 can also act as a stop to prevent the wheel 22 from falling to ground when the skate is lifted. For example, turning to FIG. 3, a rear portion 37 can be provided on each bracket arm 32 whereby when the bracket arm 32 pivots about axle 36 in a counterclockwise direction, rear portion 37 will move against and be stopped by leaf spring 60. As one skilled in the art will readily recognize, many other alternative methods can be employed for limiting the travel of rear portion 37 towards the leaf spring 60 in order to prevent the wheels from falling to ground when the skate is lifted, for example, during normal skating maneuvers.

Figure 5:
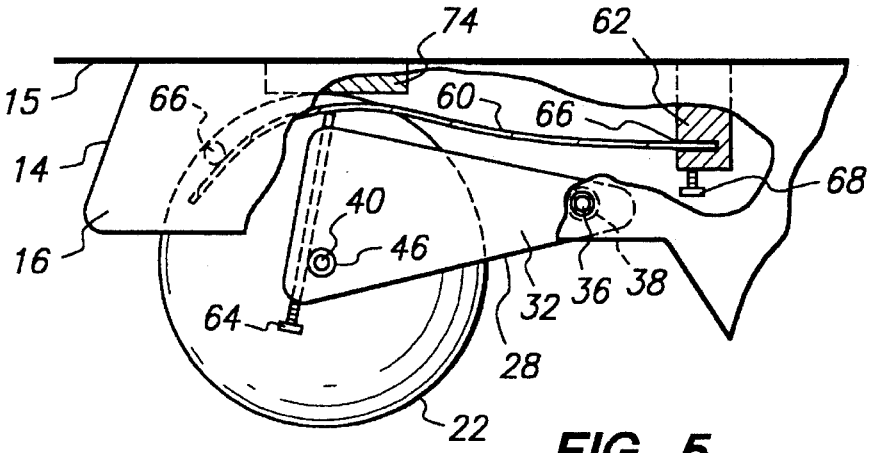
FIG. 5 is a side view, with parts broken away, illustrating the braking device of FIGS. 3 and 4 in a braking position.

Braking action with the present embodiment of the invention is illustrated in FIG. 5. Braking is accomplished when the skater exerts sufficient downward force with the toe section of the boot to overcome the resiliency of leaf springs 60 and 70. When leaf springs 60 and 70 are sufficiently flexed, wheel 22 contacts a braking surface. Braking surface can optionally include a brake pad, as shown in FIGS. 3 through 8. If base 15 is constructed from metal or hard plastic, the coefficient of friction when contacted with a wheel may be sufficient so that a smooth, obstruction-free contact surface will provide an adequate braking surface. When the skater removes the downward force from wheel 22, such as when the skater resumes a normal skating position, leaf springs 60 and 70 force wheel 22 away from the braking surface 74 allowing free rotation of wheel 22 about axle 40. If a brake pad is used to cover braking surface 74, it should preferably be removably fixed to the skate to permit replacement of the brake pad when worn.

Leaf spring 60 can be removably secured to post 62, for example, by placing a first end of the leaf spring in a matching groove 66 of post 62, and tightening bolt 68 which is threaded into post 68 to extend into groove 66. Leaf spring 70 can be removably secured to an additional post (not shown) in a similar manner. The present embodiment allows for the replacement of leaf springs 60 and 70 with leaf springs having different resiliency characteristics (e.g., more flexible or stiffer) to adjust the braking device to the skater's weight and skating skill. The present invention thus provides for an in-line skate braking device which is suitable for skaters of a wide range of ages, skating abilities and body weights.

Referring to FIGS. 3 and 5, by using an adjustable finger, such as thumb screw 64 in conjunction with leaf spring 60, and a similar thumb screw threaded through bracket arm 34 cooperating with leaf spring 70, the width of the gap between wheel 22 and base 15 when the skate is in a normal skating position can be enlarged or decreased. For example, threading these thumb screws further into their respective brackets results in an increase in the gap between wheel 22 and base 15, thus increasing the gap between wheel 22 and brake surface 74, consequently requiring a greater downward force on wheel 22 in order to make frictional contact between wheel 22 and braking surface 74. Likewise, backing the thumb screws out of their respective brackets will decrease the gap between wheel 22 and base 15, thus decreasing the gap between wheel 22 and brake surface 74, consequently requiring a lesser downward force on wheel 22 to make frictional contact between wheel 22 and braking surface 74. These thumb screws thus provide an alternate means for adjusting the braking device of the present invention to the specific needs of the skater based on the skater's body weight or skating skills.

The center wheel 24 (or center wheels) can be raised or lowered by means known to those skilled in the art. For example, axle 71 of center wheel 24 in FIG. 1 can be secured to track assembly 14 through matching slot 72 in side wall 16 and a corresponding slot (not shown) in side wall 18. These slots provide a means for adjusting the height of center wheel 24. When wheel 24 is lower than wheels 22 and 26, the skate wheels have a rocker profile as illustrated in FIG. 1. The thumb screws threaded through brackets 32 and 34 provide a novel means for adjusting the rocker profile of an in-line skate because this provides a method for raising or lowering wheel 22 relative to center wheel 24.

Figure 6:
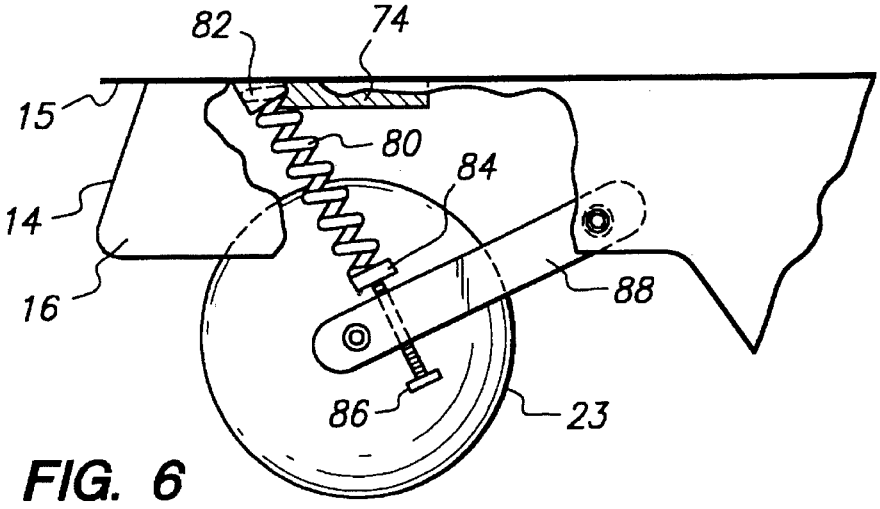
FIG. 6 is a side view, with parts broken away, of an alternate in-line skate braking device of the present invention.

Alternate embodiments of the present invention illustrating different examples of resilient means are shown in FIGS. 6 through 9. FIG. 6 discloses a brake device similar to the device illustrated in FIGS. 3 through 5 except that the resilient element of FIG. 6 consists of a helical compression spring. Helical spring 80 can be removably attached to base 15, e.g., by inserting a first end of spring 80 into a cylinder 82 which is secured to base 15. A second end of helical spring 80 can be inserted into a cylinder 84 mounted on the threaded end of thumb screw 86. Bracket arm 88 forms a pivoting linkage between wheel 23 and track 14 similar to bracket arm 32 described in connection with FIG. 3. A similar bracket arm (not shown), helical spring (not shown) and thumb screw (not shown) are provided on the other side of wheel 23.

Figure 7:
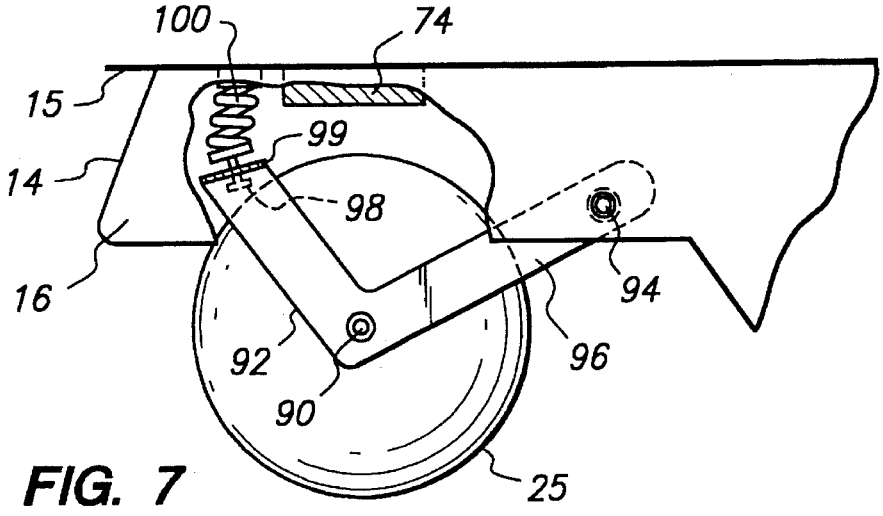
FIG. 7 is a side view, with parts broken away, of an additional alternate in-line skate braking device of the present invention.

FIG. 7 illustrates a braking device according to the current invention wherein axle 90 of wheel 25 is rotatably mounted in bracket 92 which is pivotally connected to track 14 through axle 94. Bracket 92 consists of L-shaped bracket arm 96 and an identical L-shaped bracket arm (not shown) on the other side of wheel 25. A first end of these bracket arms is connected, forming an arch shaped bracket section 99 across wheel 25. A thumb screw 98 can be threaded through the center of arch shaped section 99. Axle 94 is rotatably mounted on the L-shaped bracket arms through matching holes in a second end of the bracket arms. Axle 90 is mounted on the L-shaped brackets through matching holes in the "elbow" section of these brackets. A helical compression spring 100 can be removably secured to thumb screw 98 and base 15 in a manner similar to spring 80 as described in connection with FIG. 6.

Thumb screws 86 and 98 shown in FIGS. 6 and 7 respectively provide wheel gap adjustments similar to the adjustments described in connection with thumb screw 64 in FIG. 3. Helical springs used in the braking devices illustrated in FIGS. 6 and 7 are preferably removably secured to the skate in order to enable the skater to install and use helical springs having the spring characteristics which are most suitable for meeting the specific needs of the skater.

Figure 8:
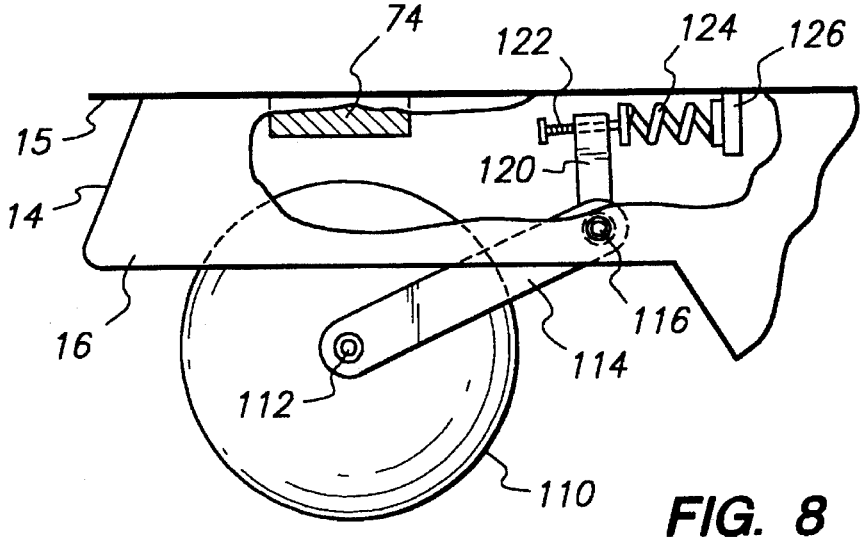
FIG. 8 is a side view, with parts broken away, of an alternate in-line skate braking device of the present invention.

The embodiment depicted in FIG. 8 illustrates a braking device wherein axle 112 of wheel 110 is rotatably mounted in a first end of bracket arm 114 and a first end of a similar bracket arm (not shown) mounted on the other side of wheel 110. A second end of these bracket arms are secured to the track assembly 14 preferably using axle 116. Axle 116 is pivotally mounted on track assembly 14 through matching holes in side walls 16 and 18. A first end of a lever 120 is secured to axle 116 between the bracket arms 114, resulting in a rigid subassembly consisting of axle 116, bracket arms 114 and lever 120. A second end of lever 120 is threaded to receive thumb screw 122. A helical spring can be removably attached to thumb screw 122 and post 126 in the manner described in connection with spring 80 (FIG. 6). Post 126 can be fixed to base 15 or through assembly 14. In this embodiment, when thumb screw 122 is rotated towards post 126, lever 120 will be forced away from post 126, and the gap between braking surface 74 and wheel 110 will be increased. The reverse will occur when thumb screw 122 is backed out away from post 126.

Alternate embodiments of the present invention include braking devices with resilient elements similar to those depicted in FIGS. 1 through 8 but without means to adjust the gap between the wheel and the base such as provided through the use of thumb screws 64, 86, 98 and; 122. Thus, in FIGS. 3 through 5, spring 60 can abut the top of bracket arm 32, or a fixed finger mounted on the top of bracket arm 32. In FIG. 6 helical spring 80 can be removably secured to bracket arm 88 by attaching cylinder 84 to bracket arm 88. Similarly, in FIG. 7 helical spring 100 can be removably secured to arch section 99, and in FIG. 8 helical spring 124 can be removably secured to lever 122.

Figure 9:
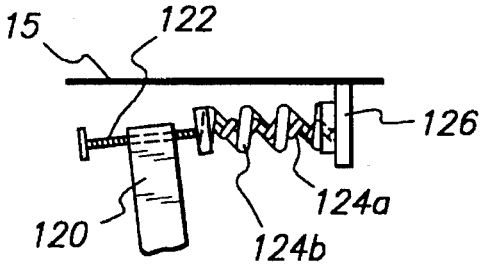
FIG. 9 is a side view of an alternate resilient means of the present invention.

In an additional alternate embodiment (not shown) of the present invention, a suitable resilient means can be provided through the use of a combination of two or more springs. For example, a suitable resilient means can consist of two helical springs having different spring diameters. This is illustrated in FIG. 9 wherein small diameter helical spring **124*a* is removably mounted inside large diameter spring 124*b*. The combination of these two helical springs provides different resiliency characteristics than a single spring such as 124 (FIG. 8**).

While the resilient means of the present invention are illustrated using resilient elements comprising leaf springs and helical compression springs, it will be apparent to those skilled in the art that other resilient elements, such as, for example, elastomeric springs, tension springs and torsion springs are included within the scope of the present invention.

The embodiments of the braking device of the present invention are illustrated by means of a front wheel braking device. Alternately, the braking device can consist of a rear wheel braking device. Preferably, a skate according to the present invention includes a front wheel braking device as well as a rear wheel braking device of the instant invention.

Accordingly, the present invention provides a braking device for in-line skates which enables a skater to selectively brake or slow down in a controlled manner and to execute take-offs and landings on a wheel equipped with this braking device.

The invention has been described in terms of the preferred embodiment. One skilled in the art will recognize that it would be possible to construct the elements of the present invention from a variety of means and to modify the placement of components in a variety of ways. While the preferred embodiments have been described in detail and shown in the accompanying drawings, it will be evident that various further modifications are possible without departing from the scope of the invention as set forth in the following claims.

I claim:

1. A braking device for an in-line roller skate comprising:

a base of said in-line skate extending substantially along a bottom surface of a boot for an in-line skate;

a bracket having substantially identical first and second bracket arms, each of said bracket arms having at a first end a means for mounting a skate wheel axle, and at a second end a means for pivotally mounting said bracket arms to said base wherein said bracket arms are spaced apart and substantially parallel whereby said bracket can pivot about an axis which is substantially transverse to the longitudinal axis of said base and substantially parallel to the plane of said base thus permitting the first end of said bracket arms to pivot towards and away from said base;

a skate wheel which is load bearing during normal skating movements;

an axle rotatably supporting said wheel during normal skating movements which axle is mounted between the first end of said bracket arms;

a braking surface on said base; and a spring means for biasing said first end of said bracket arms to a position away from said base wherein said skate wheel is disengaged from said braking surface during normal skating movements and such that upon exerting additional downward force to said wheel the biasing is overcome by said additional force wherein said bracket pivots towards said base until said wheel frictionally engages said braking surface thus resulting in braking action.

2. The braking device according to claim 1 wherein said bracket is pivotally mounted on a rigid wheel support track secured to project from said base.

3. The braking device according to claim 1 wherein said braking surface includes a braking pad mounted to project from said base.

4. The braking device according to claim 1 wherein said spring means is removably secured to the base.

5. The braking device according to claim 2 wherein said spring means is removably secured to said base.

6. The braking device according to claim 1 wherein said spring means comprises a leaf spring.

7. The braking device according to claim 1 additionally comprising a means for adjusting the distance between said wheel and said braking surface during normal skating movements.

8. The braking device according to claim 7 wherein said adjusting means comprises a rotatable thumb screw threadably mounted to said bracket for contacting said spring means.

9. The braking device according to claim 8 wherein a first end of said rotatable thumb screw is removably secured to said spring means.

10. An in-line roller skate comprising:

a base;

a means attached to a top surface of said base for securing the skate to the skater's foot;

three or more wheels attached to said skate and supported for rotation, including a first outer wheel located beneath the skater's toes, a second outer wheel located beneath the skater's heel, and one or more center wheels located between the first and second outer wheels;

a braking surface located on said skate adjacent to said wheels; and a braking device operably attached to at least one of the first outer wheel or the second outer wheel, said braking device comprising: (1) a bracket interposed between said outer wheel and said base, said bracket having substantially identical bracket arms, a first end of said bracket arms mounting said outer wheel for rotation and a second end of said bracket arms pivotally mounted to a mounting means attached to said base whereby said bracket can pivot about an axis which is substantially transverse to the longitudinal axis of said base and substantially parallel to the plane of said base thus permitting the first end of said bracket arms and attached wheel to pivot towards and away from said base, (2) a spring mounted between said bracket and said base for biasing said first end of said bracket arms to a position wherein said skate wheel is spaced away from said braking surface during normal skating movements, whereby when the skater shifts his weight and places additional downward force to said wheel, the spring biasing is overcome and said wheel frictionally engages said braking surface.

11. The in-line skate according to claim 10 wherein said braking device is operably attached to said first outer wheel.

12. The in-line skate according to claim 10 wherein said braking device is operably attached to said second outer wheel.

13. The in-line skate according to claim 10 wherein said braking device is operably attached to both said first and second outer wheels.

14. The in-line skate according to claim 13 wherein the axles supporting the outer wheels are closer to said base than the axles of the center wheels to provide rockering when said wheels of said skate are positioned on a skating surface.

15. The in-line skate according to claim 10 wherein the means for securing the skate to the skater's foot is a skate boot.

16. The in-line skate according to claim 10 wherein said spring comprises a helical spring.

17. The in-line skate according to claim 10 wherein said braking surface includes a braking pad mounted to project from said base.

18. The in-line roller skate of claim 10 wherein said mounting means for mounting said second end of said bracket arms to said base is a rigid wheel support track secured to project from said base and aligned parallel to a longitudinal axis of said base.

19. The in-line roller skate of claim 10 wherein said spring of said braking device has predetermined biasing characteristics and is mounted for removal and replacement by a skater whereby a spring having the biasing characteristics desired by the skater may be used to space said skate wheel away from said braking surface during normal skating movements whereby said skate wheel may be forced into contact with the braking surface during skating by a downward force sufficient to overcome the predetermined biasing of said spring.

20. A braking device for an in-line roller skate, said in-line roller skate including a base, a means attached to a top surface of the base for securing the skate to the skater's foot, and a rigid track mounted to the base and positioned parallel to a longitudinal axis of the base for mounting a first outer wheel beneath the skater's toes, a second outer wheel beneath the skater's heel, and one or more center wheels located between the first and second outer wheels, said braking device comprising:

a bracket having substantially identical first and second bracket arms, said bracket arms being substantially parallel and spaced apart, said bracket arms having a first end mounting one of the outer wheels for rotation, and a second end of said bracket arms pivotally mounted to the track, whereby the wheel can pivot towards and away from the base;

a braking surface on said base; and, a spring mounted between said bracket and said base for biasing said wheel away from said braking surface, said spring having predetermined biasing characteristics and mounted for removal and replacement by a skater whereby a spring having the biasing characteristics desired by the skater may be used to space said wheel away from said braking surface during normal skating movements whereby said wheel may be forced into contact with the braking surface during skating by a downward force sufficient to overcome the predetermined biasing of said spring.

* * * * *